US005794792A

United States Patent [19]

Convertino

[11] Patent Number: 5,794,792

[45] Date of Patent: Aug. 18, 1998

[54] WASHING AND DRYING RACK FOR RESEABLE BAGS

[76] Inventor: Robert P. Convertino, 8565 Indian Hill Rd., Manlius, N.Y. 13104

[21] Appl. No.: 763,845

[22] Filed: Dec. 3, 1996

Related U.S. Application Data

[63] Continuation-in-part of Ser. No. 534,615, Sep. 25, 1995, abandoned.

[51] Int. Cl.[6] ..... A47F 7/00

[52] U.S. Cl. ..... 211/12; 248/97

[58] Field of Search ..... 211/12, 13; 248/97, 248/99

[56] References Cited

U.S. PATENT DOCUMENTS

| | | | |
|---|---|---|---|
| D. 342,357 | 12/1993 | Balk . | |
| 5,080,237 | 1/1992 | Hefner | 211/12 X |
| 5,188,244 | 2/1993 | Hollstegge . | |
| 5,303,827 | 4/1994 | Ross . | |
| 5,641,137 | 6/1997 | Collier | 211/12 X |

*Primary Examiner*—Alvin C. Chin-Shue
*Assistant Examiner*—Sarah Purol
*Attorney, Agent, or Firm*—Trapani & Molldrem

[57] ABSTRACT

An apparatus is provided for use in the cleaning of a plastic bag. The apparatus comprises a base structure which contains an opening for allowing fluid to pass therethrough. A bag support structure extends from the base structure, and is configured to support a plastic bag in such an orientation that the opening of the bag is in fluid communication with the opening of the base structure. The bag support structure is also configured to keep the opening of the bag open to permit a flow of fluid into and out of the bag. Clips or other retaining devices are also included for retaining the plastic bag on the support structure. In operation, fluid is permitted to pass through the base structure and flow into the plastic bag, and then flow back out of the bag and pass back through the base structure.

10 Claims, 3 Drawing Sheets

WASHING AND DRYING RACK FOR RESEABLE BAGS

This application is a continuation-in-part of application Ser. No. 08/534,615, filed Sep. 25, 1995.

BACKGROUND OF THE INVENTION

1. Technical Field

The present invention relates generally to household utensils, and more particularly, to racks that support plastic bags for washing and drying the bags.

2. Background Art

For some time, people have cleaned plastic bags for later reuse in order to save the cost of purchasing new plastic bags and to minimize the accumulation of plastic bags as refuse in landfills. This process involves manually washing the plastic bag in a sink and then placing the cleaned bag on a counter top or drip pan to dry. This process is time consuming and not very efficient. In many cases, the interior surfaces of the plastic bag do not completely dry, because the bag is generally closed or collapsed during the drying step.

Conventional dish racks have been available for supporting dishes, pots and pans, for drying after being washed. However, such racks are not suitable for plastic bags because they do not provide adequate support for the bags during the drying step.

An attempt has been made to design a drying rack especially for plastic bags. In U.S. Pat. No. 3,295,694 to Nejezchleb et al, a drying rack for plastic bags is disclosed. The rack comprises a drip tray and a plurality of bag supporting members standing upright in the tray. The plastic bag is held open by the supporting members to allow air into the bag for drying. Although the rack may be suitable for supporting plastic bags for drying, it is not suitable for washing the bags. An open path is not provided which allows water or other cleaning fluid to flow into the bag while it is supported by the supporting members. Thus, the patent to Nejezchleb et al. does not offer a comprehensive solution to the old manual process of washing and drying plastic bags for reuse. In fact, the patent to Nejezchleb et al. continues the manual process, rather than offer an automated approach.

Most kitchens in modern society are equipped with automatic dishwashers. However, heretofore, no means have been provided to take advantage of the automatic dishwasher with respect to washing and drying plastic bags. The rack disclosed in the patent to Nejezchleb et al. is wholly inadequate for use in a dishwasher, because its drip tray blocks the upward flow of water and soap into the bag. A need therefore exists for an efficient and automated approach to washing and drying plastic bags for reuse. The present invention has fulfilled this need by providing a means which may be used with an automatic dishwasher to automate the process of washing and drying plastic bags.

OBJECT AND SUMMARY OF THE INVENTION

It is therefore an object of the present invention to provide apparatus and methods for cleaning plastic bags which avoid the problems associated with the prior art.

It is another object of the present invention to provide automated methods for cleaning plastic bags.

It is a further object of the present invention to provide apparatus and methods for cleaning plastic bags which utilize the advantages and capabilities of an automatic dishwasher.

It is yet another object of the present invention to provide an apparatus for cleaning a plastic bag which allows a flow of water or other cleaning fluid into the bag during a washing cycle.

It is yet a further object of the present invention to provide an apparatus for cleaning a plastic bag which allows a flow of air or other fluid into the bag during a drying cycle.

It is still another object of the present invention to provide an apparatus for cleaning a plastic bag which is capable of supporting a plastic bag during the cleaning and drying cycles of an automatic dishwasher.

It is still a further object of the present invention to provide an apparatus for cleaning a plastic bag which is self-draining during use.

It is yet still another object of the present invention to provide an apparatus for cleaning a plastic bag which is self-cleaning during use.

It is yet still a further object of the present invention to provide an apparatus for cleaning a plastic bag having a simple design which can be scaled up or down to accommodate different sized bags.

It is yet still a further object of the present invention to provide apparatus and methods for cleaning plastic bags which reduce the waste disposal burden on the environment.

It is yet still a further object of the present invention to provide apparatus and methods for cleaning plastic bags which save money by reducing the frequency of purchases of plastic bags.

These and other objects are attained in accordance with the present invention wherein there is provided an apparatus for use in the cleaning of a plastic bag. The apparatus comprises a base structure which contains an opening for allowing fluid to pass therethrough. A bag support structure extends from the base structure, and is configured to support a plastic bag in such an orientation that the opening of the bag is in fluid communication with the opening of the base structure. The bag support structure is also configured to keep the opening of the bag open to permit a flow of fluid into and out of the bag. In operation, fluid is permitted to pass through the base structure and flow into the plastic bag, and then flow back out of the bag and pass back through the base structure.

In the preferred embodiment, the bag support structure includes a plurality of upright support members or ribs which are spaced apart and disposed along the base structure. The support members are configured and dimensioned to fit inside of and support the plastic bag. The support members are spaced apart along a width dimension which is less than the width of the plastic bag. Each of the support members has a depth dimension sufficient to spread the sides of the plastic bag apart and keep the bag open, and may have a length substantially corresponding to the length of the plastic bag. A means is also provided for retaining the plastic bag on the support members.

A method of cleaning a plastic bag is also contemplated by the present invention. The method of the present invention comprises the steps of (a) placing the plastic bag in an automatic dishwasher; (b) supporting the bag in the dishwasher, in a position that substantially aligns the opening of the bag with a water discharge path in the dishwasher; (c) keeping the opening of the bag open during operation of the dishwasher, such that water is directed into and allowed to drain out of the bag; and (d) operating the dishwasher at least through a wash cycle. The method may further include retaining the bag in position during operation of the dishwasher, and operating the dishwasher through both wash and dry cycles.

The primary advantage of the present invention is that it automates the process of washing and drying used plastic bags for re-use. The present invention replaces the burdensome and inefficient task of manually washing and drying plastic bags with an easy and efficient method utilizing the capabilities of an automatic dishwasher.

BRIEF DESCRIPTION OF THE DRAWING

Further objects of the present invention will become apparent from the following description of the preferred embodiment with reference to the accompanying drawing, in which.

DETAILED DESCRIPTION OF THE PREFERRED EMBODIMENT

Figure 1:
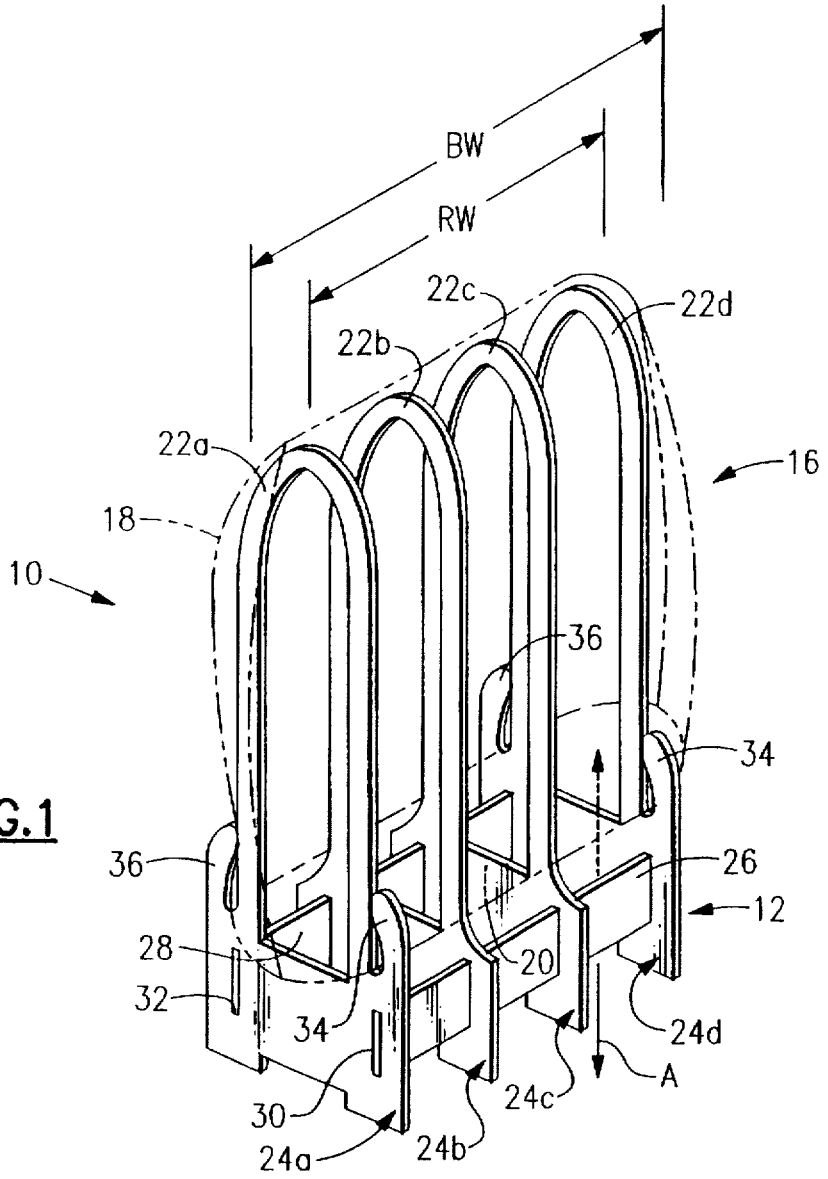
FIG. 1 is a perspective view of a rack for cleaning a plastic bag, constructed in accordance with the present invention, showing a plastic bag (in phantom lines) being supported by the rack.
Figure 2:
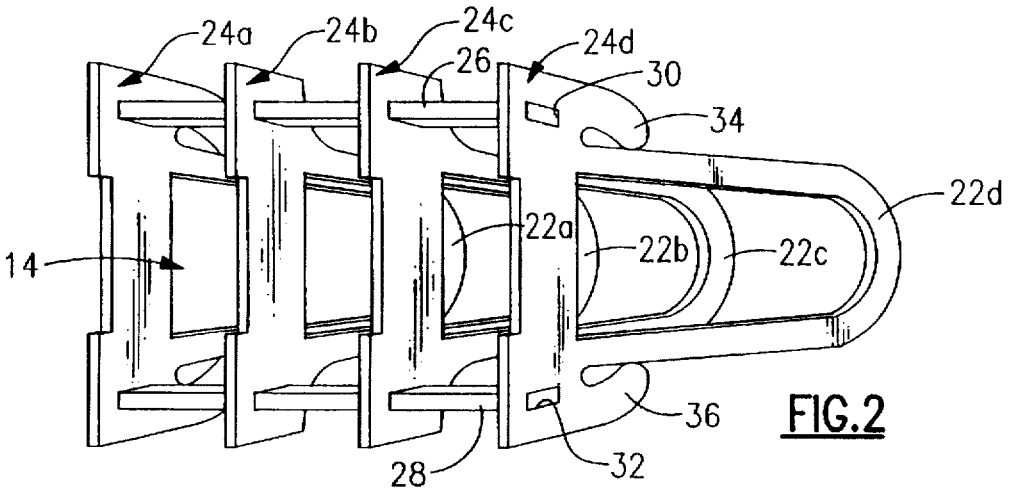
FIG. 2 is a bottom perspective view of the rack of FIG. 1, shown without the plastic bag.

Referring now to FIGS. 1–4, there is shown a rack 10 constructed in accordance with the present invention. Rack 10 is designed for use in cleaning plastic bags as will be described in greater detail hereinbelow. Rack 10 includes a base structure 12 which contains an opening 14 (See FIG. 2) for allowing fluid (designated schematically by arrow A in FIG. 1) to pass through base 12. Rack 10 further includes a bag support structure 16 extending from base structure 12.

Figure 3:
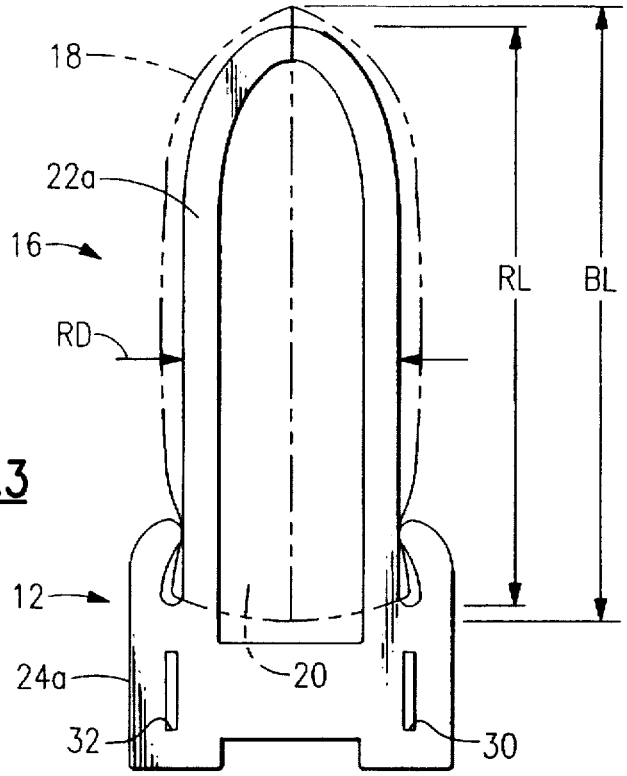
FIG. 3 is a side elevation view of the rack of FIG. 1, shown with the plastic bag.
Figure 4:
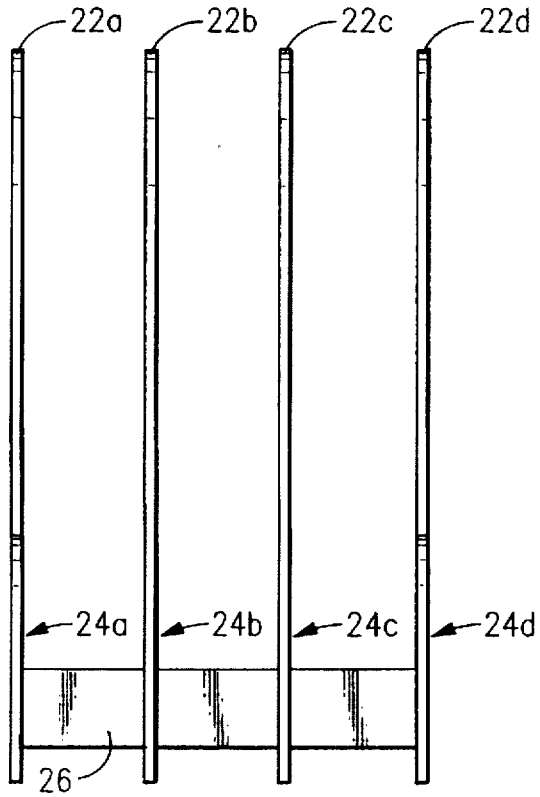
FIG. 4 is a front elevation view of the rack of FIG. 1, shown without the plastic bag.

As shown in FIGS. 1 and 3, bag support structure 16 is configured to support a plastic bag 18 (shown in phantom lines) in such an orientation that an opening 20 of bag 18 is in fluid communication with opening 14 of base structure 12. Bag support structure 16 is also configured to keep opening 20 open, to permit a flow of fluid into and out of bag 18 (See arrow A in FIG. 1). As understood from FIG. 1, fluid (arrow A) is permitted to pass through base structure 12 and flow into bag 18, and then flow back out of bag 18 and pass back through base structure 12.

In the preferred embodiment, as shown in FIGS. 1–4, bag support structure 16 includes four upright support members or ribs **22*a*–22*d*. Support members 22*a*–22*d* are spaced apart and disposed along base structure 12. As shown in FIG. 1, support members 22*a*–22*d* are configured and dimensioned to fit inside of plastic bag 18 and support bag 18 in such an orientation that opening 20 is in fluid communication with opening 14 of base structure 12. Support members 22*a*–22*d* are spaced apart along a width dimension RW (See FIG. 1) which is designed to be less than the width (BW) of bag 18. As illustrated in FIG. 3, each of support members 22*a*–22*d* has a depth dimension RD sufficient to spread the sides of bag 18 apart and keep the bag open. Each of support members 22*a*–22*d* may have a length RL which substantially corresponds to the length (BL) of bag 18** (See FIG. 3).

It is to be understood that the cleaning rack of the present invention is not limited to a particular construction or embodiment. It is preferred that rack 10 be of a basket type construction, that will enable the washing of plastic bags in an automatic dishwasher or aid in the drying process after hand washing. The construction shown in FIGS. 1–4 is but one example of how the rack can be implemented. As shown in FIGS. 1–4, support members **22*a*–22*d* are configured as elongated arches or ribs. Support members 22*a*–22*d* are an integral part of panels 24*a*–24*d*, respectively. In this particular construction, the bottom portions of panels 24*a*–24*d* form part of base structure 12. The construction of base structure 12 is completed by inserting a pair of cross-members or slats 26 and 28 through slotted holes 30 and 32, respectively, contained in the bottom portions of each of panels 24*a*–24*d***.

The end panels of rack 10, i.e., panels **24*a* and 24*d*, each include a pair of retaining fingers 34 and 36. The ends of retaining fingers 34 and 36 are positioned very close to support member 22*a* (and 22*d*). Fingers 34 and 36 cooperate with their respective support member (22*a* and 22*d*) to function has clips, which retain bag 18 on support members 22*a*–22*d* (or on support structure 16). The open end of bag 18 is pushed down between retaining fingers 34, 36 and their respective support member to secure each end of bag 18 to rack 10**.

Rack 10 can be made in several different sizes to handle a variety of different sized bags available on the market. It is contemplated that the construction of rack 10 will remain the same for all rack sizes. Rack 10 can be made out of a heat resistant plastic, using the most economically available technologies in manufacturing (e.g., injection molding, etc.).

It is contemplated that rack 10 will be used to wash and dry plastic storage bags of the type typically used for the storage of food, and sold in grocery stores. Two well known bags sell under the names of GLADBAG® and ZIPLOC®.

Figure 5:
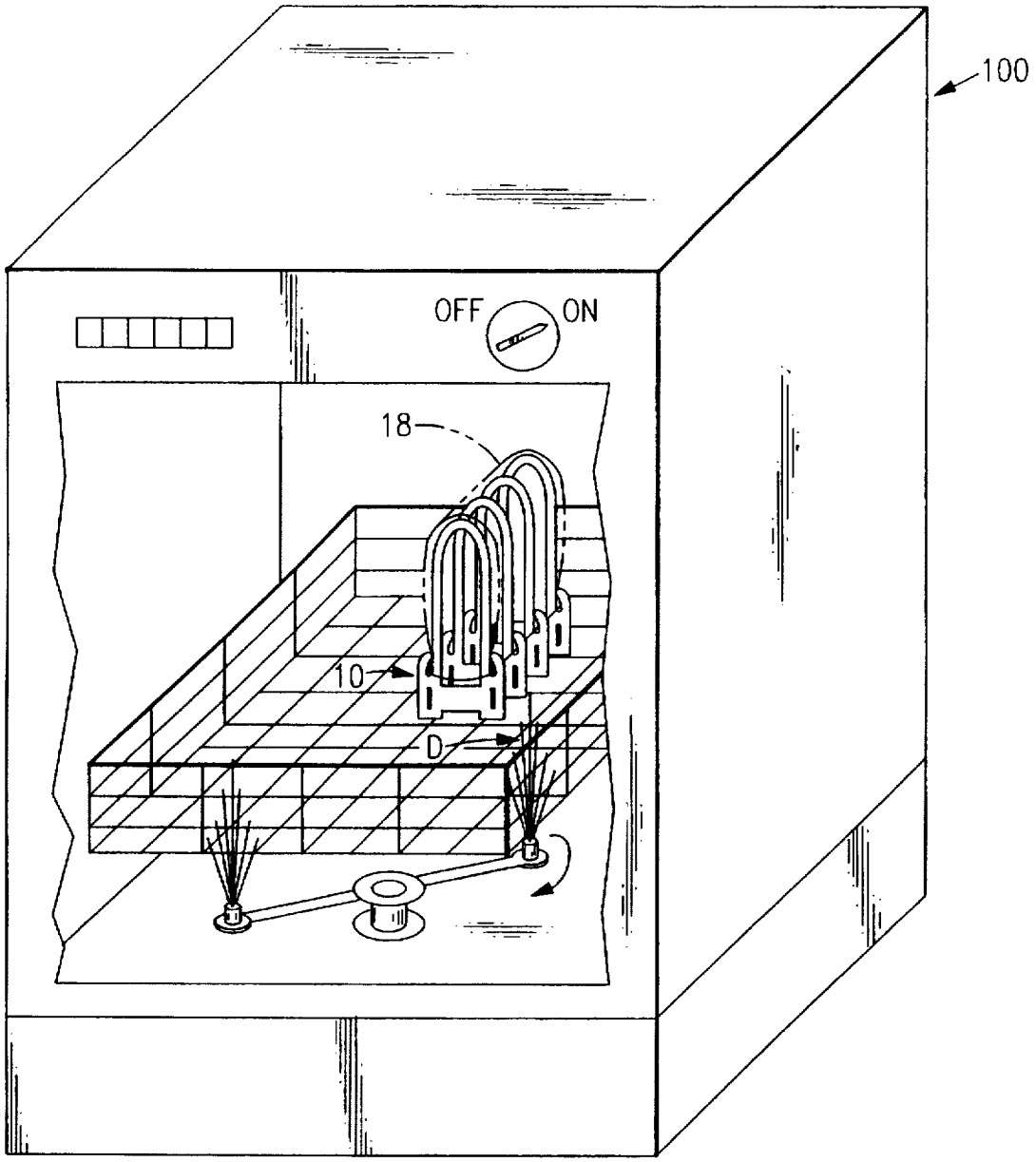
FIG. 5 is a perspective view showing the rack of FIG. 1 supporting a plastic bag in an automatic dishwasher, in accordance with a method of the present invention.

A method of cleaning a plastic bag, using an automatic dishwasher, will now be described with reference to FIGS. 1 and 5. Initially, a used or dirty plastic bag 18 is secured to rack 10, as illustrated in FIG. 1. This is done by inverting bag 18 and draping it over support members **22*a*–22*d*, and then pulling down until the open end of bag 18 engages retaining fingers 34, 36 on panels 24*a* and 24*d*. The end of bag 18 is pushed between retaining fingers 34, 36 and support members 22*a* and 22*d* to secure bag 18. Once bag 18 is secured to rack 10, it is placed into an automatic dishwasher 100, as shown in FIG. 5. Rack 10 supports bag 18 in dishwasher 100, in a position that substantially aligns the opening of bag 18 with a water discharge "D" generated by dishwasher 100. Water discharge D is conventionally produced by dishwasher 100 for the purpose of washing or rinsing, and is shown in FIG. 5 to be directed in an upward path. Rack 10 keeps the opening of bag 18 open during operation of dishwasher 100, such that water is directed into and allowed to drain out of bag 18. Dishwasher 100 is operated at least through a wash cycle, and preferably through both wash and dry cycles. Retaining fingers 34, 36, on each side of rack 10, retain bag 18 in position during operation of dishwasher 100**.

While the preferred embodiment of the invention has been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims.

What I claim is:

1. An apparatus for use in the cleaning of a plastic bag, comprising:

a base structure which contains an opening for allowing fluid to pass therethrough;

a bag support structure extending from said base structure and being configured to support a plastic bag in such an orientation that the opening of the bag is in fluid communication with the opening of said base structure, and to keep the opening of the bag open to permit a flow of fluid into and out of the bag; and at least one retaining finger for grippingly retaining the bag, whereby fluid is permitted to pass through said base structure and flow into the plastic bag, and flow out of the plastic bag and pass through said base structure.

2. The apparatus as recited in claim 1, wherein said bag support structure includes a plurality of upright support members being spaced apart and disposed along said base structure, said plurality of support members being configured and dimensioned to fit inside of and support the plastic bag.

3. The apparatus as recited in claim 2, wherein said plurality of support members are spaced apart along a width dimension which is less than the width of the plastic bag.

4. The apparatus as recited in claim 3, wherein each of said plurality of support members has a length substantially corresponding to the length of the plastic bag.

5. The apparatus as recited in claim 4, wherein each of said plurality of support members has a depth dimension sufficient to spread the sides of the plastic bag apart and keep the bag open.

6. The apparatus as recited in claim 5, further comprising means for retaining the plastic bag on at least one of said plurality of support members.

7. The apparatus as recited in claim 1, further comprising means for retaining the plastic bag on said bag support structure.

8. An apparatus for washing and drying a plastic bag, comprising:

a base structure which contains an opening for allowing fluid to pass therethrough;

a plurality of bag support members extending out from and disposed along said base structure, said plurality of support members being configured to fit inside a plastic bag and support the bag in such an orientation that the opening of the bag is in fluid communication with the opening of said base structure, and to keep the opening of the bag open to permit a flow of fluid into and out of the bag; and a plurality of retaining fingers for grippingly retaining the plastic bag, whereby fluid is permitted to pass through said base structure and flow into the plastic bag, and to flow back out of the bag and pass back through said base structure.

9. A method of cleaning a plastic bag, comprising the steps of:

(a) placing the plastic bag in an automatic dishwasher;

(b) supporting the bag in the dishwasher, in a position that substantially aligns the opening of the bag with a water discharge path in the dishwasher;

(c) keeping the opening of the bag open during operation of the dishwasher, such that water is directed into and allowed to drain out of the bag;

(d) grippingly retaining the bag by means of retaining fingers such that the position of the bag as recited in step (b) is substantially maintained during operation of the dishwasher; and (e) operating the dishwasher at least through a wash cycle.

10. The method as recited in claim 9, wherein said step (e) includes operating the automatic dishwasher through both wash and dry cycles.

* * * * *

UNITED STATES PATENT AND TRADEMARK OFFICE

CERTIFICATE OF CORRECTION

PATENT NO. : 5,794,792

DATED : August 18, 1998

INVENTOR(S) : Robert P. Convertino

It is certified that error appears in the above-identified patent and that said Letters Patent is hereby corrected as shown below:

On the title page, item [54] and col. 1, line 2,

The title should read:

--WASHING AND DRYING RACK FOR RESEALABLE BAGS--.

Signed and Sealed this

Twenty-ninth Day of December, 1998

*Attest:*

*Attesting Officer*

Bruce Lehman

BRUCE LEHMAN

*Commissioner of Patents and Trademarks*